US006223758B1

(12) United States Patent
Feldman

(10) Patent No.: US 6,223,758 B1
(45) Date of Patent: May 1, 2001

(54) NOVELTY UMBRELLA FOR A CHILD

(76) Inventor: Allan R. Feldman, 90 S. Park Ave. #A8, Rockville Centre, NY (US) 11570

( * ) Notice: Subject to any disclaimer, the term of this patent is extended or adjusted under 35 U.S.C. 154(b) by 0 days.

(21) Appl. No.: 09/436,734

(22) Filed: Nov. 9, 1999

(51) Int. Cl.[7] ..... A45B 25/20

(52) U.S. Cl. ..... 135/33.2; 135/15.1; D3/6; D3/12; D3/15

(58) Field of Search ..... 135/15.1, 16, 33.2, 135/910; D3/5, 6, 12, 15

(56) References Cited

U.S. PATENT DOCUMENTS

| | | | | |
|---|---|---|---|---|
| D. 52,545 | * | 10/1918 | Schedler . | |
| D. 273,055 | * | 3/1984 | Lee | D3/6 |
| D. 339,910 | * | 10/1993 | Flanagan | D3/6 |
| D. 341,831 | * | 11/1993 | Mozdzanowski | D14/168 |
| D. 359,614 | | 6/1995 | Bauman | D3/6 |
| D. 379,116 | * | 5/1997 | Selberg | D3/6 |
| D. 390,696 | | 2/1998 | Bauman | D3/5 |
| D. 395,159 | | 6/1998 | Santos | D3/5 |
| D. 400,701 | * | 11/1998 | Wu | D3/5 |
| D. 411,762 | * | 7/1999 | You | D3/6 |
| 2,221,366 | * | 11/1940 | Bisbing et al. . | |
| 3,899,168 | * | 8/1975 | Besherse | 135/16 |
| 4,031,381 | | 6/1977 | Carver | 240/6.42 |
| 4,364,193 | * | 12/1982 | Visco | 135/16 X |
| 4,597,400 | * | 7/1986 | Trudeau | 135/18 |
| 4,872,468 | | 10/1989 | Cole | 135/16 |
| 5,280,799 | | 1/1994 | Alajajian | 135/16 |
| 5,287,872 | * | 2/1994 | Anderson | 135/98 |

* cited by examiner

*Primary Examiner*—Robert Canfield
(74) *Attorney, Agent, or Firm*—Richard L. Miller, P.L.

(57) ABSTRACT

A novelty umbrella for a child that includes a rod, a frame, and a cover. The rod has a pair of handles that extend radially outwardly from its proximal end and are shoe-like and a pair of hands that extend radially outwardly from its midpoint and are arm-like. The frame includes a plurality of ribs pivotally mounted to the rod. The cover includes a plurality of panels, each of which extends as a web between a pair of adjacent ribs, is made from a glow-in-the dark material for allowing the child to be more safely visible to traffic, and is provided with a transparent portion for allowing the child to see through the cover without having to lift it up. The cover further includes a plurality of eyelashes disposed above the portions, respectively, and a smile that is disposed between an adjacent pair of portions, orthogonally from the pair of hands, and together with the adjacent pair of portions and an associated pair of eyelashes, cooperate with the cover to form a head, with the rod forming a body, the pair of hands forming arms, and the pair of handles forming feet.

18 Claims, 1 Drawing Sheet

NOVELTY UMBRELLA FOR A CHILD

BACKGROUND OF THE INVENTION

1. Field of the Invention

The present invention relates to an umbrella. More particularly, the present invention relates to a novelty umbrella for a child.

2. Description of the Prior Art

Children are reluctant to carry umbrellas.

Therefore, there exists a need for an umbrella that works like a regular umbrella and is perceived by a child as a more personal item that will be more highly valued and cared for by the child, and therefore ultimately more consistently used by the child.

Numerous innovations for umbrellas have been provided in the prior art that will be described. Even though these innovations may be suitable for the specific individual purposes to which they address, however, they differ from the present invention.

A FIRST EXAMPLE, U.S. Pat. No. Des. 359,614 to Bauman teaches the ornamental design for a transparent umbrella.

A SECOND EXAMPLE, U.S. Pat. No. Des. 390,696 to Bauman teaches the ornamental design for opaque umbrella with transparent panel.

A THIRD EXAMPLE, U.S. Pat. No. Des. 395,159 to Santos teaches the ornamental design for a flashing light taxi alert umbrella.

A FOURTH EXAMPLE, U.S. Pat. No. 4,031,381 to Carver teaches an umbrella adapted to be illuminated selectively when in its open position. A hollow tubular shaft supports the umbrella hood by means of a hub slidably mounted on the shaft. The hub carries an electrical conductor cooperable with electrical contacts in the bulb circuit and with the switch preventing illumination of the bulb unless the hood is open and then only by means of the switch.

A FIFTH EXAMPLE, U.S. Pat. No. 4,872,468 to Cole teaches an umbrella designed to provide added safety to a user by making L the user more visible in darkness to a motorist. Primarily, it consists of a strip on its canopy that is both reflective and will glow when light is provided by either an on board light system or externally from passing car headlights etcetera. The on board lighting system includes a handle for a pole, a battery, a bulb, and a reflector, and a switch for closing a circuit to cause light to be emitted from at least one end of the handle.

A SIXTH EXAMPLE, U.S. Pat. No. 5,280,799 to Alajajian teaches an umbrella that when folded functions as a conventional flashlight, and when opened functions as an umbrella with a two-way flashlight handle. The flashlight handle contains two lamps/reflectors. One is located in the side of the umbrella handle. The other is positioned in the base of the handle. The handle also serves as a battery compartment for a plurality of "AA" size batteries. The lamp/reflector at the base of said handle is intended to produce the illuminating power of a conventional flashlight. The lamp/reflector at the side of said handle is intended to provide illumination for the forward path of the umbrella user when the umbrella is fully extended. The side lamp/reflector is positioned to direct light onto the forward path of the user when the handle is held vertically.

Either lamp may be activated at a time via a two-way switch, located on side of said handle, when said umbrella is either folded or fully extended. With the umbrella opened and the handle held vertically, activation of the side lamp provides the user lighting to his forward path while activation of the lower lamp illuminates the ground near the user's feet. With the umbrella folded and held horizontally, only the base lamp is normally activated for operation consistent with that of a conventional flashlight.

It is apparent that numerous innovations for umbrellas have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a novelty umbrella for a child that avoids the disadvantages of the prior art.

ANOTHER OBJECT of the present invention is to provide a novelty umbrella for a child that is simple and inexpensive to manufacture.

STILL ANOTHER OBJECT of the present invention is to provide a novelty umbrella for a child that is simple to use.

BRIEFLY STATED, YET ANOTHER OBJECT of the present invention is to provide a novelty umbrella for a child that includes a rod, a frame, and a cover. The rod has a pair of handles that extend radially outwardly from its proximal end and are shoe-like and a pair of hands that extend radially outwardly from its midpoint and are arm-like. The frame includes a plurality of ribs pivotally mounted to the rod. The cover includes a plurality of panels, each of which extends as a web between a pair of adjacent ribs, is made from a glow-in-the dark material for allowing the child to be more safely visible to traffic, and is provided with a transparent portion for allowing the child to see through the cover without removing having to lift it up. The cover further includes a plurality of eyelashes disposed above the portions, respectively, and a smile that is disposed between an adjacent pair of portions, orthagonally from the pair of hands, and together with the adjacent pair of portions and an associated pair of eyelashes, cooperate with the cover to form a head, with the rod forming a body, the pair of hands forming arms, and the pair of handles forming feet.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 3:
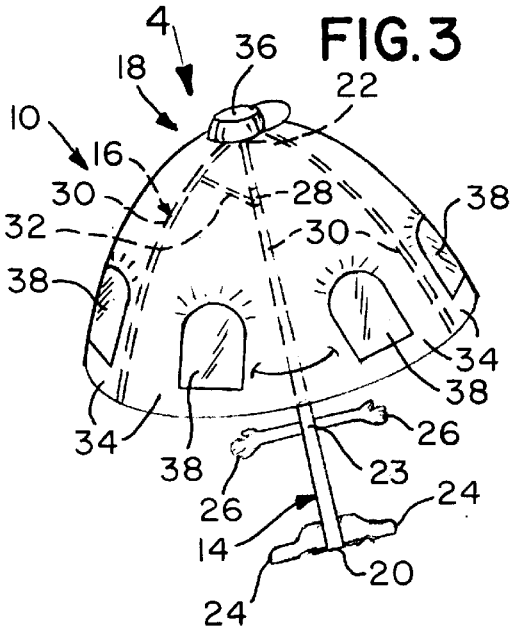
FIG. 3 is a diagrammatic perspective view of the area generally enclosed by the dotted curve identified by arrow 3 in FIG. 1 of the present invention.

10 novelty umbrella for child 12
12 child

14 rod
16 frame
18 cover
20 proximal end of rod 14
22 distal end of rod 14
23 midpoint of rod 14
24 pair of handles of rod 14
26 pair of hands of rod 14
28 runner of frame 16
30 plurality of ribs of frame 16
32 plurality of stretchers of frame 16
34 plurality of panels of cover 18
36 crown of cover 18
38 portion of each panel of plurality of panels 34 of cover 18 for allowing child 12 to see through cover 18 without having to lift it up
40 plurality of eyelashes on cover 18
42 smile on cover 18

DETAILED DESCRIPTION OF THE PREFERRED EMBODIMENT

Figure 1:
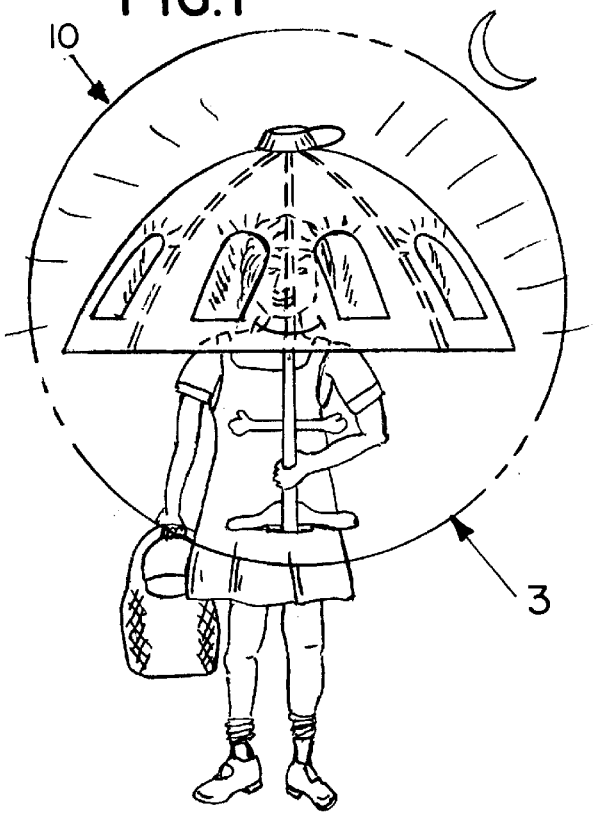
FIG. 1 is a diagrammatic front elevational view of the present invention in the unfolded mode and in use.
Figure 2:
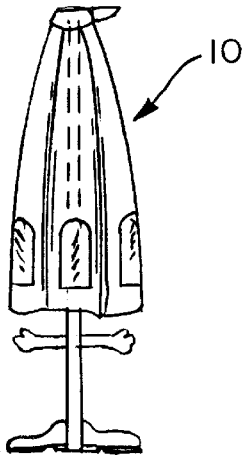
FIG. 2 is a diagrammatic front elevational view of the present invention in the folded mode and not in use.

Referring now to the figures, in which like numerals indicate like parts, and particularly to FIGS. 1 and 2, the novelty umbrella of the present invention is shown generally at 10 for a child 12.

Figure 4:
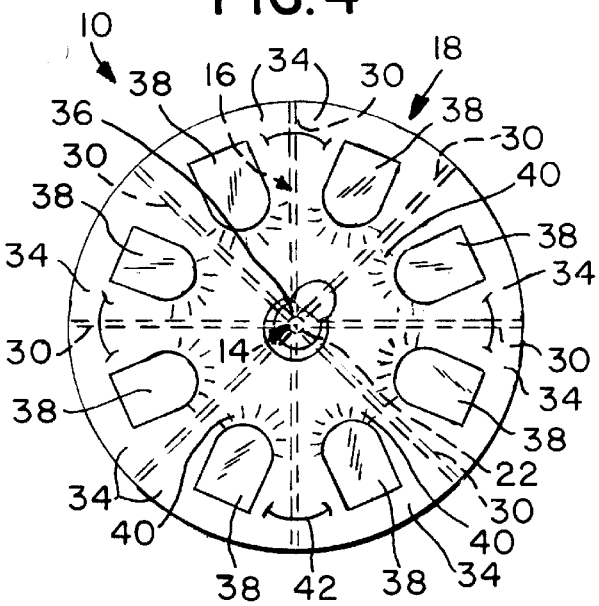
FIG. 4 is a diagrammatic top plan view taken generally in the direction of arrow 4 in FIG. 3.

The configuration of the novelty umbrella 10 can best be seen in FIGS. 3 and 4, and as such, will be discussed in reference thereto.

The novelty umbrella 10 comprises a rod 14, a frame 16 movably mounted on the rod 12, and a cover 18 covering the frame 14.

The rod 14 is sender, elongated, and has a proximal end 20, a distal end 22, and a midpoint 23 that is midway between the proximal end 20 of the rod 14 and the distal end 22 of the rod 14.

The rod 14 further has a pair of handles 24 that are diametrically opposed to each other, collinear with each other, and extend radially outwardly from the proximal end 20 of the rod 14.

The pair of handle 24 of the rod 14 are shoe-like.

The rod 14 further has a pair of hands 26 that are diametrically opposed to each other, collinear with each other, gand extend radially outwardly from, and for steadying by the child 12, the midpoint 23 of the rod 14, and are disposed in line with the pair of handles 24 of the rod 14.

The pair of hands 26 of the rod 14 are arm-like.

The rod 14 is made from plastic.

The frame 16 comprises a runner 28 that is slidably mounted around the rod 14.

The frame 16 further comprises a plurality of ribs 30 that are pivotally mounted to the distal end 22 of the rod 14.

The frame 16 further comprises a plurality of stretchers 32.

Each stretcher 32 of the frame 16 is pivotally attached at one end to the runner 28 of the frame 16 and pivotally attached at the other end to an associated rib 30 of the frame 14, which allows the frame 16 to fold and unfold when the runner 28 of the frame 16 is moved up and down the rod 14.

The cover 18 comprises a plurality of panels 34.

Each panel 34 of the cover 18 extends as a web between a pair of adjacent ribs 30 of the frame 16.

Each panel 34 of the cover 18 is made from a glow-in-the dark material for allowing the child 12 to be more safely visible to traffic.

The cover 18 further comprises a crown 36 that is disposed on the cover 18, at the distal end 22 of the rod 14.

The crown 36 of the cover 18 is cap-like for a male child 12.

The crown 36 of the cover 18 is beret-like for a female child 12.

The crown 36 of the cover 18 is hair-like for a female child 12.

Each panel 34 of the cover 18 is provided with a portion 38 for allowing the child 12 to see through the cover 18 without having to lift it up.

Each panel 34 of the cover 18 is transparent, eyelid-like, and sewn into the cover 18.

The cover 18 further comprises a plurality of eyelashes 40 that are disposed above the portions 38 of said plurality of panels 34, respectively.

The plurality of eyelashes 40 are painted on the cover 18.

The cover 18 further comprises a smile 42 that is disposed on the cover 18, between an adjacent pair of portions 38 of the plurality of panels 34, orthagonally from the pair of hands 26 of the rod 14, and together with the adjacent pair of portions 38 of the plurality of panels 34 and an associated pair of eyelashes 40, cooperate with the cover 18 to form a head, with the rod 23 forming a body, the pair of hands 26 forming arms, and the pair of handles 24 forming feet.

The smile 42 is painted on the cover 18.

It will be understood that each of the elements described above, or two or more together, may also find a useful application in other types of constructions differing from the types described above.

While the invention has been illustrated and described as embodied in a novelty umbrella for a child, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A novelty umbrella for a child, comprising:

a) a rod;

b) a frame movably mounted on said rod; and c) a cover covering said frame, wherein said rod is sender, elongated, and has:

i) a poximal end:

ii) a distal end; and iii) a midpoint that is midway between said proximal end of said rod and said distal end of said rod, wherein said rod further has a pair of handles that are diametrically opposed to each other, collinear with each other, and extend radially outwardly from said proximal end of said rod, wherein said rod further has a pair of hands that are diametrically opposed to each other, collinear with each other, and extend radially outwardly from, and for steadying by the child, said midpoint of said rod, and are disposed in line with said pair of handles of said rod.

2. The umbrella as defined in claim 1, wherein said pair of handles of said rod are shoe-like.

3. The umbrella as defined in claim 1, wherein said pair of hands of said rod are arm-like.

4. The umbrella as defined in claim 1, wherein said rod is made from plastic.

5. The umbrella as defined in claim 1, wherein said frame comprises a runner that is slidably mounted around said rod.

6. The umbrella as defined in claim 5, wherein said frame further comprises a plurality of ribs that are pivotally mounted to said distal end of said rod.

7. The umbrella as defined in claim 6, wherein said frame further comprises a plurality of stretchers.

8. The umbrella as defined in claim 7, wherein each stretcher of said frame is pivotally attached at one end to said runner of said frame and pivotally attached at the other end to an associated rib of said frame, which allows said frame to fold and unfold when said runner of said frame is moved up and down said rod.

9. The umbrella as defined in claim 6, wherein said cover comprises a plurality of panels.

10. The umbrella as defined in claim 9, wherein each panel of said cover extends as a web between a pair of adjacent ribs of said frame.

11. The umbrella as defined in claim 10, wherein each panel of said cover is provided with a portion for allowing the child to see through said cover without having to lift it up.

12. The umbrella as defined in claim 11, wherein said cover further comprises a plurality of eyelashes that are disposed above said portions of said plurality of panels, respectively.

13. The umbrella as defined in claim 12, wherein said plurality of eyelashes are painted on said cover.

14. The umbrella as defined in claim 12, wherein said cover further comprises a smile that is disposed on said cover, between an adjacent pair of portions of said plurality of panels, orthagonally from said pair of hands of said rod, and together with said adjacent pair of portions of said plurality of panels and an associated pair of eyelashes, cooperate with said cover to form a head, with said rod forming a body, said pair of hands forming arms, and said pair of handles forming feet.

15. The umbrella as defined in claim 14, wherein said smile is painted on said cover.

16. The umbrella as defined in claim 10, wherein each panel of said cover is transparent, eyelid-like, and sewn into said cover.

17. The umbrella as defined in claim 9, wherein each panel of said cover is made from a glow-in-the dark material for allowing the child to be more safely visible to traffic.

18. The umbrella as defined in claim 1, wherein said cover further comprises a crown that is disposed on said cover, at said distal end of said rod.

* * * * *